US008104621B2

(12) United States Patent
Weismantel et al.

(10) Patent No.: US 8,104,621 B2
(45) Date of Patent: Jan. 31, 2012

(54) METHOD FOR GRADING A PARTICULATE WATER-ABSORBING RESIN

(75) Inventors: Matthias Weismantel, Jossgrund-Oberndorf (DE); Rüdiger Funk, Niedernhausen (DE); Thomas Daniel, Waldsee (DE); Uwe Stueven, Bad Soden (DE)

(73) Assignee: BASF Aktiengesellschaft

( * ) Notice: Subject to any disclaimer, the term of this patent is extended or adjusted under 35 U.S.C. 154(b) by 863 days.

(21) Appl. No.: 11/813,306

(22) PCT Filed: Dec. 31, 2005

(86) PCT No.: PCT/EP2005/014163

§ 371 (c)(1),
(2), (4) Date: Jul. 3, 2007

(87) PCT Pub. No.: WO2006/074816

PCT Pub. Date: Jul. 20, 2006

(65) Prior Publication Data

US 2008/0202987 A1 Aug. 28, 2008

(30) Foreign Application Priority Data

Jan. 13, 2005 (DE) ..... 10 2005 001 789

(51) Int. Cl.
*B07B 1/46* (2006.01)

(52) U.S. Cl. ..... 209/238

(58) Field of Classification Search ..... 209/312, 209/318, 591, 295, 238; 502/402
See application file for complete search history.

(56) References Cited

U.S. PATENT DOCUMENTS

| | | | | |
|---|---|---|---|---|
| 3,719,276 | A | 3/1973 | Allen et al. | |
| 3,948,764 | A | 4/1976 | Edwards | |
| 4,261,817 | A | 4/1981 | Edwards et al. | |
| 5,122,262 | A * | 6/1992 | Summers | 209/321 |
| 5,380,808 | A * | 1/1995 | Sumiya et al. | 526/317.1 |
| 6,164,455 | A * | 12/2000 | Kakita et al. | 209/11 |
| RE38,444 | E * | 2/2004 | Wada et al. | 524/559 |
| 6,716,894 | B2 * | 4/2004 | Kajikawa et al. | 522/150 |
| 2003/0087983 | A1 | 5/2003 | Kajikawa et al. | |
| 2008/0306209 | A1 * | 12/2008 | Stueven et al. | 524/706 |
| 2009/0208748 | A1 * | 8/2009 | Torii et al. | 428/402 |

FOREIGN PATENT DOCUMENTS

EP 0 855 232 7/1998

OTHER PUBLICATIONS

Buchholz, et al. *Modern Superabsorbent Polymer Technology*, Wiley-VCH, pp. 69-117 (1998).

International Search Report in PCT/EP2005/014163 dated Mar. 30, 2006.

Ullmanns, *Encyklopaedie der technischen Chemie, 4th Edition*, vol. 2, pp. 43-46, Verlag Chemie, Weinheim (1973).

* cited by examiner

*Primary Examiner* — Jeremy R Severson
(74) *Attorney, Agent, or Firm* — Marshall, Gerstein & Borun LLP

(57) ABSTRACT

Process for classifying a particulate water-absorbing resin using a sieving apparatus at a reduced pressure compared with the ambient pressure and a sieving apparatus for classifying a particulate water-absorbing resin at a reduced pressure compared with the ambient pressure.

19 Claims, No Drawings

METHOD FOR GRADING A PARTICULATE WATER-ABSORBING RESIN

CROSS-REFERENCE TO RELATED APPLICATIONS

This is the U.S. national phase application of International Application No. PCT/EP2005/014163, filed Dec. 31, 2005, which claims the benefit of German patent application No. 10 2005 001 789.4, filed Jan. 13, 2005.

The present invention relates to a process for classifying a particulate water-absorbing resin using a sieving apparatus at a reduced pressure compared with the ambient pressure and also to a sieving apparatus for classifying a particulate water-absorbing resin at a reduced pressure compared with the ambient pressure.

The production of water-absorbing resins has been extensively described, see for example "Modern Superabsorbent Polymer Technology", F. L. Buchholz and A. T. Graham, Wiley-VCH, 1998, pages 69 to 117.

Water-absorbing resins typically have a Centrifuge Retention Capacity in the range from 15 to 60 g/g, preferably of not less than 20 g/g, more preferably of not less than 25 g/g, even more preferably of not less than 30 g/g and most preferably of not less than 35 g/g. Centrifuge Retention Capacity (CRC) is determined by EDANA (European Disposables and Nonwovens Association) recommended test method No. 441.2-02 "Centrifuge retention capacity".

The process for producing water-absorbing resins typically comprises the steps of addition polymerizing, drying, comminuting, classifying, postcrosslinking and, if appropriate, renewed classifying.

A general overview of classifying is to be found for example in Ullmanns Encykiopädie der technischen Chemie, 4th edition, volume 2, pages 43 to 56, Verlag Chemie, Weinheim, 1972.

But there is a problem with the classifying of water-absorbing resins specifically in that the sieving performance is reduced by agglomeration. Thus, EP-A-0 855 232 teaches that the sieves used have to be kept in a heated and/or thermally insulated state.

US 2003/87983 teaches that sieving at elevated temperature greatly increases metal abrasion and hence wear of the sieving apparatus.

The present invention has for its object to provide a simplified process for classifying water-absorbing resins whereby high sieving performances and long apparatus service lives are achieved.

We have found that this object is achieved by classifying water-absorbing resins at reduced pressure compared with the ambient pressure, preferably at a pressure of not more than 950 mbar, preferably at a pressure of not more than 900 mbar, more preferably at a pressure of not more than 800 mbar and most preferably at a pressure of not more than 700 mbar. The pressure is typically not less than 10 mbar preferably not less than 50 mbar, more preferably not less than 100 mbar, even more preferably not less than 200 mbar and most preferably not less than 300 mbar. A further aspect of the present invention is the sieving apparatus for carrying out the classifying process of the present invention.

The sieving apparatuses useful for the classifying process of the present invention are not subject to any restriction, preference being given to planar sieve processes and most preference to tumble sieving machines. The sieving apparatus is typically shaken to assist classification. This is preferably accomplished by leading the material to be classified over the sieve in spiral form. Typically, this forced vibration has an amplitude in the range from 0.7 to 40 mm and preferably in the range from 1.5 to 25 mm and a frequency in the range from 1 to 100 Hz and preferably in the range from 5 to 10 Hz.

Preferably, a gas stream passes over the water-absorbing resin during the classifying process, and more preferably this gas stream is air. The gas rate is typically in the range from 0.1 to 10 $m^3/h$ per $m^2$ of sieve area, preferably in the range from 0.5 to 5 $m^3/h$ per $m^2$ of sieve area and more preferably in the range from 1 to 3 $m^3/h$ per $m^2$ of sieve area, the gas volume being measured under standard conditions (25° C. and 1 bar). More preferably, the gas stream is incipiently heated before entry into the sieving apparatus, typically to a temperature of not less than 40° C., preferably to a temperature of not less than 50° C., more preferably to a temperature of not less than 60° C., even more preferably to a temperature of not less than 65° C. and most preferably to a temperature of not less than 70° C. The temperature of the gas stream is typically less than 120° C., preferably less than 110° C., more preferably less than 100° C., even more preferably less than 90° C. and most preferably less than 80° C. The water content of the gas stream is typically not more than 5 g/kg, preferably not more than 4.5 g/kg, more preferably not more than 4 g/kg, even more preferably not more than 3.5 g/kg and most preferably not more than 3 g/kg. A gas stream having a low water content can be generated for example by condensing a sufficient amount of water out of a gas stream having a higher water content, by cooling.

In addition, the sieving apparatus may be heated and/or thermally insulated, for example as described in EP-A-0 855 232. Typically, the sieving apparatus is operated at a temperature in the range from 40 to 80° C.

Useful water-absorbing resins for the process of the present invention can be produced by addition polymerization of a monomer solution comprising i) at least one ethylenically unsaturated acid-functional monomer,
ii) at least one crosslinker,
iii) if appropriate one or more ethylenically and/or allylically unsaturated monomers copolymerizable with i), and
iv) if appropriate one or more water-soluble polymers onto which the monomers i), ii) and if appropriate iii) can be at least partly grafted, the base polymer obtained being dried, classified, v) if appropriate aftertreated with at least one postcrosslinker, dried and thermally postcrosslinked.

Suitable monomers i) are for example ethylenically unsaturated carboxylic acids, such as acrylic acid, methacrylic acid, maleic acid, fumaric acid and itaconic acid, or derivatives thereof, such as acrylamide, methacrylamide, acrylic esters and methacrylic esters. Acrylic acid and methacrylic acid are particularly preferred monomers. Acrylic acid is most preferable.

The monomers i) and especially acrylic acid comprise preferably up to 0.025% by weight of a hydroquinone half ether. Preferred hydroquinone half ethers are hydroquinone monomethyl ether (MEHQ) and/or tocopherols.

Tocopherol refers to compounds of the following formula:

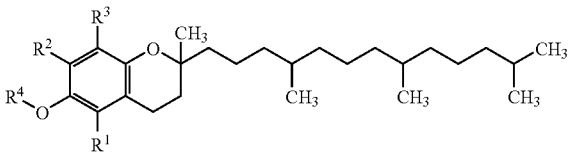

where $R^1$ is hydrogen or methyl, $R^2$ is hydrogen or methyl, $R^3$ is hydrogen or methyl and $R^4$ is hydrogen or an acyl radical of 1 to 20 carbon atoms.

Preferred $R^4$ radicals are acetyl, ascorbyl, succinyl, nicotinyl and other physiologically tolerable carboxylic acids. The carboxylic acids can be mono-, di- or tricarboxylic acids.

Preference is given to alpha-tocopherol where $R^1=R^2=R^3$=methyl, especially racemic alpha-tocopherol. $R^4$ is more preferably hydrogen or acetyl. RRR-alpha-Tocopherol is preferred in particular.

The monomer solution comprises preferably not more than 130 weight ppm, more preferably not more than 70 weight ppm, preferably not less than 10 weight ppm, more preferably not less than 30 weight ppm and especially about 50 weight ppm of hydroquinone half ether, all based on acrylic acid, with acrylic acid salts being arithmetically counted as acrylic acid. For example, the monomer solution can be produced using an acrylic acid having an appropriate hydroquinone half ether content.

The water-absorbing polymers are in a crosslinked state, i.e., the addition polymerization is carried out in the presence of compounds having two or more polymerizable groups which can be free-radically interpolymerized into the polymer network. Useful crosslinkers ii) include for example ethylene glycol dimethacrylate, diethylene glycol diacrylate, allyl methacrylate, trimethylolpropane triacrylate, triallylamine, tetraallyloxyethane as described in EP-A-0 530 438, di- and triacrylates as described in EP-A-0 547 847, EP-A-0 559 476, EP-A-0 632 068, WO-A 93/21237, WO-A 03/104299, WO-A 03/104300, WO-A 03/104301 and in German patent application 103 31 450.4, mixed acrylates which, as well as acrylate groups, comprise further ethylenically unsaturated groups, as described in German patent applications 103 31 456.3 and 103 55 401.7, or crosslinker mixtures as described for example in DE-A 195 43 368, DE-A 196 46 484, WO-A-90/15830 and WO-A-02/32962.

Useful crosslinkers ii) include in particular N,N'-methylenebisacrylamide and N,N'-methylenebismethacrylamide, esters of unsaturated mono- or polycarboxylic acids of polyols, such as diacrylate or triacrylate, for example butanediol diacrylate, butanediol dimethacrylate, ethylene glycol diacrylate, ethylene glycol dimethacrylate and also trimethylolpropane triacrylate and allyl compounds, such as allyl (meth) acrylate, triallyl cyanurate, diallyl maleate, polyallyl esters, tetraallyloxyethane, triallylamine, tetraallylethylenediamine, allyl esters of phosphoric acid and also vinylphosphonic acid derivatives as described for example in EP-A-0 343 427. Useful crosslinkers ii) further include pentaerythritol diallyl ether, pentaerythritol triallyl ether, pentaerythritol tetraallyl ether, polyethylene glycol diallyl ether, ethylene glycol diallyl ether, glycerol diallyl ether, glycerol triallyl ether, polyallyl ethers based on sorbitol, and also ethoxylated variants thereof. The process of the present invention utilizes di(meth) acrylates of polyethylene glycols, the polyethylene glycol used having a molecular weight between 300 and 1000.

However, particularly advantageous crosslinkers ii) are di- and triacrylates of 3- to 20-tuply ethoxylated glycerol, of 3- to 20-tuply ethoxylated trimethylolpropane, of 3- to 20-tuply ethoxylated trimethylolethane, especially di- and triacrylates of 2- to 6-tuply ethoxylated glycerol or of 2- to 6-tuply ethoxylated trimethylolpropane, of 3-tuply propoxylated glycerol, of 3-tuply propoxylated trimethylolpropane, and also of 3-tuply mixedly ethoxylated or propoxylated glycerol, of 3-tuply mixedly ethoxylated or propoxylated trimethylolpropane, of 15-tuply ethoxylated glycerol, of 15-tuply ethoxylated trimethylolpropane, of at least 40-tuply ethoxylated glycerol, of at least 40-tuply ethoxylated trimethylolethane and also of at least 40-tuply ethoxylated trimethylolpropane.

Very particularly preferred for use as crosslinkers ii) are diacrylated, dimethacrylated, triacrylated or trimethacrylated multiply ethoxylated and/or propoxylated glycerols as described for example in prior German patent application DE 103 19 462.2. Di- and/or triacrylates of 3- to 10-tuply ethoxylated glycerol are particularly advantageous. Very particular preference is given to di- or triacrylates of 1- to 5-tuply ethoxylated and/or propoxylated glycerol. The triacrylates of 3- to 5-tuply ethoxylated and/or propoxylated glycerol are most preferred. These are notable for particularly low residual levels (typically below 10 weight ppm) in the water-absorbing polymer and the aqueous extracts of water-absorbing polymers produced therewith have an almost unchanged surface tension compared with water at the same temperature (typically not less than 0.068 N/m).

Examples of ethylenically unsaturated monomers iii) which are copolymerizable with the monomers i) are acrylamide, methacrylamide, crotonamide, dimethylaminoethyl methacrylate, dimethylaminoethyl acrylate, dimethylaminopropyl acrylate, diethylaminopropyl acrylate, dimethylaminobutyl acrylate, dimethylaminoethyl methacrylate, diethylaminoethyl methacrylate, dimethylaminoneopentyl acrylate and dimethylaminoneopentyl methacrylate.

Useful water-soluble polymers iv) include polyvinyl alcohol, polyvinylpyrrolidone, starch, starch derivatives, polyglycols or polyacrylic acids, preferably polyvinyl alcohol and starch.

The preparation of a suitable base polymer and also further useful hydrophilic ethylenically unsaturated monomers i) are described in DE-A-199 41 423, EP-A-0 686 650, WO-A-01/45758 and WO-A-03/104300.

The reaction is preferably carried out in a kneader as described for example in WO-A-01/38402, or on a belt reactor as described for example in EP-A-0 955 086.

The acid groups of the hydrogels obtained are typically in a partially neutralized state, the extent of neutralization preferably being in the range from 25 to 95 mol %, more preferably in the range from 27 to 80 mol % and even more preferably in the range from 27 to 30 mol % or from 40 to 75 mol %, for which the customary neutralizing agents can be used, for example alkali metal hydroxides, alkali metal oxides, alkali metal carbonates or alkali metal bicarbonates and also mixtures thereof. Ammonium salts can also be used instead of alkali metal salts. Sodium and potassium are particularly preferred as alkali metals, but most preference is given to sodium hydroxide, sodium carbonate or sodium bicarbonate and also mixtures thereof. Typically, neutralization is achieved by admixing the neutralizing agent as an aqueous solution, as a melt or else preferably as a solid material. For example, sodium hydroxide having a water fraction of distinctly below 50% by weight can be present as a waxy mass having a melting point above 23° C. In this case, metering as piece goods or melt at elevated temperature is possible.

Neutralization can be carried out after polymerization, at the hydrogel stage. But it is also possible to neutralize up to 40 mol %, preferably from 10 to 30 mol % and more preferably from 15 to 25 mol % of the acid groups before polymerization by adding a portion of the neutralizing agent to the monomer solution and setting the desired final degree of neutralization only after polymerization, at the hydrogel stage. The monomer solution may be neutralized by admixing the neutralizing agent. The hydrogel can be mechanically comminuted, for example by means of a meat grinder, in which case the neutralizing agent can be sprayed, sprinkled or poured on and then carefully mixed in. To this end, the gel mass obtained can be repeatedly minced for homogenization. Neutralization of the monomer solution directly to the final degree of neutralization is preferred.

The neutralized hydrogel is then dried with a belt or drum dryer until the residual moisture content is preferably below 15% by weight and especially below 10% by weight, the water content being determined by EDANA (European Disposables and Nonwovens Association) recommended test method No. 430.2-02 "Moisture content". Selectively, drying can also be carried out using a fluidized bed dryer or a heated plowshare mixer. To obtain particularly white products, it is advantageous to dry this gel by ensuring rapid removal of the evaporating water. To this end, the dryer temperature must be optimized, the air feed and removal has to be policed, and at all times sufficient venting must be ensured. Drying is naturally all the more simple—and the product all the more white—when the solids content of the gel is as high as possible. The solids content of the gel prior to drying is therefore preferably between 30% and 80% by weight. It is particularly advantageous to vent the dryer with nitrogen or some other non-oxidizing inert gas. Selectively, however, simply just the partial pressure of the oxygen can be lowered during drying to prevent oxidative yellowing processes. But in general adequate venting and removal of the water vapor will likewise still lead to an acceptable product. A very short drying time is generally advantageous with regard to color and product quality.

A further important function of drying the gel is the ongoing reduction in the residual monomer content of the superabsorbent. This is because any residual initiator will decompose during drying, leading to any residual monomers becoming interpolymerized. In addition, the evaporating amounts of water will entrain any free water-vapor-volatile monomers still present, such as acrylic acid for example, and thus likewise lower the residual monomer content of the superabsorbent.

The dried hydrogel is then ground and classified, useful grinding apparatus typically including single or multiple stage roll mills, preferably two or three stage roll mills, pin mills, hammer mills or swing mills.

To improve their performance characteristics, such as Saline Flow Conductivity (SFC) in the diaper and Absorbency Under Load (AUL), water-absorbing particles of polymer are generally postcrosslinked. This postcrosslinking can be carried out in the aqueous gel phase. Preferably, however, ground and sieved-off particles of polymer (base polymer) are surface coated with a postcrosslinker, dried and thermally postcrosslinked. Useful crosslinkers for this purpose are compounds comprising two or more groups capable of forming covalent bonds with the carboxylate groups of the hydrophilic polymer or of crosslinking at least two carboxyl groups or other functional groups of at least two different polymeric chains of the base polymer together.

Useful postcrosslinkers v) are compounds comprising two or more groups capable of forming covalent bonds with the carboxylate groups of the polymers. Useful compounds are for example alkoxysiyl compounds, polyaziridines, polyamines, polyamidoamines, di- or polyglycidyl compounds as described in EP-A-0 083 022, EP-A 543 303 and EP-A 937 736, polyhydric alcohols as described in DE-C 33 14 019, DE-C 35 23 617 and EP-A 450 922, or β-hydroxyalkylamides as described in DE-A 102 04 938 and U.S. Pat. No. 6,239,230. It is also possible to use compounds of mixed functionality, such as glycidol, 3-ethyl-3-oxetanemethanol (trimethylolpropaneoxetane), as described in EP-A 1 199 327, aminoethanol, diethanolamine, triethanolamine or compounds which develop a further functionality after the first reaction, such as ethylene oxide, propylene oxide, isobutylene oxide, aziridine, azetidine or oxetane.

Useful postcrosslinkers v) are further said to include by DE-A 40 20 780 cyclic carbonates, by DE-A 198 07 502 2-oxazolidone and its derivatives, such as N-(2-hydroxyethyl)-2-oxazolidone, by DE-A 198 07 992 bis- and poly-2-oxazolidones, by DE-A 198 54 573 2-oxotetrahydro-1,3-oxazine and its derivatives, by DE-A 198 54 574 N-acyl-2-oxazolidones, by DE-A 102 04 937 cyclic ureas, by German patent application 103 34 584.1 bicyclic amide acetals, by EP-A 1 199 327 oxetanes and cyclic ureas and by WO-A-03/031482 morpholine-2,3-dione and its derivatives.

Postcrosslinking is typically carried out by spraying a solution of the postcrosslinker onto the hydrogel or the dry base-polymeric particles. Spraying is followed by thermal drying, and the postcrosslinking reaction can take place not only before but also during drying.

The spraying with a solution of postcrosslinker is preferably carried out in mixers having moving mixing implements, such as screw mixers, paddle mixers, disk mixers, plowshare mixers and shovel mixers. Particular preference is given to vertical mixers and very particular preference to plowshare mixers and shovel mixers. Useful mixers include for example Lödige® mixers, Bepex® mixers, Nauta® mixers, Processall® mixers and Schugi® mixers.

Contact dryers are preferable, shovel dryers more preferable and disk dryers most preferable as apparatus in which thermal drying is carried out. Suitable dryers include for example Bepex® dryers and Nara® dryers. Fluidized bed dryers can be used as well.

Drying can take place in the mixer itself, for example by heating the shell or blowing warm air into it. It is similarly possible to use a downstream dryer, for example a tray dryer, a rotary tube oven or a heatable screw. But it is also possible for example to utilize an azeotropic distillation as a drying process.

Preferred drying temperatures range from 50 to 250° C., preferably from 50 to 200° C., and more preferably from 50 to 150° C. The preferred residence time at this temperature in the reaction mixer or dryer is below 30 minutes and more preferably below 10 minutes.

The classifying process of the present invention is preferably carried out after the drying of the base polymer, before the postcrosslinking and/or after the postcrosslinking. The water content of the water-absorbing resin is typically in the range from 2% to 10% by weight after the drying of the base polymer or before the postcrosslinking and typically below 1% by weight and preferably below 0.1% by weight after the postcrosslinking.

The apparatus for carrying out the process of the present invention comprises a) a housing,
b) a feed line for the material to be classified,
c) at least one sieve,
d) at least two exit lines for the classified material,
e) an apparatus for pressure closed loop control,
f) if appropriate a gas feed, and
g) if appropriate a thermal insulation.

A thermal insulation is an additional layer of material on the sieving apparatus to reduce the heat lost from the sieving apparatus to the outside.

EXAMPLES

Example 1

A Lödige VT 5R-MK plowshare kneader (5 l in capacity) was charged with 388 g of deionized water, 173.5 g of acrylic acid, 2033.2 g of a 37.3% by weight sodium acrylate solution (100 mol % neutralized) and also 4.50 g of 15-tuply ethoxylated trimethylolpropane triacrylate (for example Sartomer® SR9035) and inertized for 20 minutes by bubbling nitrogen through. The polymerization was then initiated by adding dilute aqueous solutions of 2.112 g of sodium persulfate, 0.045 g of ascorbic acid and also 0.126 g of hydrogen peroxide, at 23° C. After initiation, the temperature of the heating jacket was closed loop controlled to the reaction temperature in the reactor. The crumbly gel eventually obtained was then dried at 160° C. in a circulating air drying cabinet for 3 hours. This was followed by grinding and sieving off to 250-850 μm. The water content was 2.7% by weight.

The ground base polymer was applied to the sieve at the stated temperature. The sieve was operable at reduced pressure. In addition, the sieve was blanketed with preheated air having a defined water vapor content. The air rate was 2 $m^3$/h per $m^2$ of sieve area.

| Ex. | Temperature of base polymer [° C.] | Pressure [mbar] | Temperature of gas stream [° C.] | Water vapor content of gas stream [g/kg] | Sieve performance rating |
|---|---|---|---|---|---|
| 1 | 60 | 500 | 55 | 4 | 1 |
| 2 | 60 | 500 | 75 | 4 | 1 |
| 3 | 60 | 500 | 35 | 4 | 2 |
| 4 | 60 | 500 | 25 | 4 | 3 |
| 5 | 50 | 500 | 50 | 2 | 1 |
| 6 | 50 | 1013 | 50 | 2 | 2 |
| 7 | 60 | 500 | 60 | 2 | 1 |
| 8 | 60 | 500 | 60 | 4 | 2 |
| 9 | 60 | 500 | 60 | 6 | 3 |

Sieve Performance Rating Scheme:
1 minimal adherence to sieve and walls, no clumping in sieved product
2 minimal adherence to sieve and walls, minimal clumping in sieved product
3 adherence to sieve and walls, clumps in sieved product

We claim:

1. A process for classifying a particulate water-absorbing resin using a sieving apparatus, which process comprises
(a) operating the sieving apparatus at a reduced pressure compared to ambient pressure throughout the classification process, and
(b) with a gas stream passing over the resin during the classifying process, the gas stream having a temperature of not less than 40° C. upstream of the sieving apparatus.

2. The process according to claim 1 wherein the sieving apparatus is operated at a pressure of not more than 950 mbar.

3. The process according to claim 2 wherein the sieving apparatus is operated at a pressure in the range from 300 to 700 mbar.

4. The process according to claim 3 wherein a gas rate is in the range from 0.1 to 10 $m^3$/h per $m^2$ of sieve area.

5. The process according to claim 2 wherein a gas rate is in the range from 0.1 to 10 $m^3$/h per $m^2$ of sieve area.

6. The process according to claim 1 wherein a gas rate is in the range from 0.1 to 10 $m^3$/h per $m^2$ of sieve area.

7. The process according to claim 6 wherein the gas stream is air.

8. The process according to claim 7 wherein the gas stream has a temperature in the range from 40 to 120° C.

9. The process according to claim 8 wherein a water content of the gas stream is less than 5 g/kg.

10. The process according to claim 9 wherein a gas volume stream is in the range from 1 to 10 $m^3$/h per $m^2$ sieve area, the gas volume being measured at a temperature of 25° C. and a pressure of 1 bar.

11. The process according to claim 6 wherein a water content of the gas stream is less than 5 g/kg.

12. The process according to claim 6 wherein a gas volume stream is in the range from 1 to 10 $m^3$/h per $m^2$ sieve area, the gas volume being measured at a temperature of 25° C. and a pressure of 1 bar.

13. The process according to claim 1 wherein the gas stream has a temperature in the range from 40° C. to 120° C.

14. The process according to claim 1 wherein the sieving apparatus is partly or wholly thermally insulated.

15. The process according to claim 1 wherein a temperature of the sieving apparatus is in the range from 40° C. to 80° C.

16. The process according to claim 1 wherein the sieving apparatus vibrates.

17. The process according to claim 16 wherein a frequency of vibration is in the range from 1 to 100 Hz.

18. The process according to claim 1 wherein the particulate water-absorbing resin is obtained by addition polymerization of a solution comprising acrylic acid and/or methacrylic acid.

19. The process according to claim 18 wherein the acrylic acid and/or methacrylic acid is at least 40% neutralized.

* * * * *